US007832130B2

(12) United States Patent
Sederberg et al.

(10) Patent No.: US 7,832,130 B2
(45) Date of Patent: Nov. 16, 2010

(54) MULTIPLE MOUNTING BRACKET FOR A MOBILE PROCESSOR ATTACHMENT MOUNTED ON A HYDRAULIC EXCAVATOR

(75) Inventors: Clayton Sederberg, Duluth, MN (US); Matthew G. Mecklin, Two Harbors, MN (US)

(73) Assignee: The Stanley Works, New Britain, CT (US)

( * ) Notice: Subject to any disclaimer, the term of this patent is extended or adjusted under 35 U.S.C. 154(b) by 238 days.

(21) Appl. No.: 11/543,942

(22) Filed: Oct. 6, 2006

(65) Prior Publication Data

US 2008/0083144 A1 Apr. 10, 2008

(51) Int. Cl.
*E02F 3/96* (2006.01)

(52) U.S. Cl. ..... 37/468; 37/403; 37/408; 414/723

(58) Field of Classification Search ..... 37/468, 37/403–410; 414/723
See application file for complete search history.

(56) References Cited

U.S. PATENT DOCUMENTS

| | | | | | |
|---|---|---|---|---|---|
| 2,963,183 | A | * | 12/1960 | Przybylski | 414/723 |
| 3,807,586 | A | * | 4/1974 | Holopainen | 414/694 |
| 3,977,547 | A | * | 8/1976 | Holopainen | 414/687 |
| 4,775,287 | A | * | 10/1988 | Hering, Sr. | 414/694 |
| 4,813,163 | A | | 3/1989 | Livingston et al. | 37/103 |
| 4,822,237 | A | * | 4/1989 | Meyer et al. | 414/708 |
| 4,948,328 | A | * | 8/1990 | Busch | 414/723 |
| 5,145,313 | A | | 9/1992 | Weyer | 414/723 |
| 5,195,865 | A | | 3/1993 | Koehl | 414/723 |
| 5,384,962 | A | * | 1/1995 | Pemberton | 30/134 |
| 5,423,625 | A | | 6/1995 | Gebauer et al. | 403/322 |
| 5,467,542 | A | | 11/1995 | Hulden | 37/468 |
| 5,471,747 | A | * | 12/1995 | Morikawa et al. | 30/134 |
| 5,546,683 | A | | 8/1996 | Clark | 37/468 |
| 5,575,093 | A | | 11/1996 | Pratt et al. | 37/468 |
| 5,611,158 | A | | 3/1997 | Pratt et al. | 37/468 |
| 5,618,157 | A | | 4/1997 | Pratt et al. | 414/723 |
| 5,621,987 | A | | 4/1997 | Pratt et al. | 37/468 |
| 5,791,863 | A | | 8/1998 | Droegemueller | 414/723 |
| 5,927,665 | A | | 7/1999 | Grabnic | 248/200 |
| 6,047,475 | A | * | 4/2000 | Tyrrell et al. | 30/134 |
| 6,108,951 | A | | 8/2000 | Renfrow et al. | 37/468 |
| 6,123,501 | A | | 9/2000 | Pisco | 414/723 |
| 6,163,988 | A | * | 12/2000 | Pratt et al. | 37/468 |
| 6,233,852 | B1 | | 5/2001 | Pemberton | 37/468 |

(Continued)

FOREIGN PATENT DOCUMENTS

GB 2 238 035 A 5/1995

*Primary Examiner*—Thomas A Beach
*Assistant Examiner*—Matthew R Buck
(74) *Attorney, Agent, or Firm*—Pillsbury Winthrop Shaw Pittman LLP

(57) ABSTRACT

A mounting bracket is designed to interchangeably connect a processor attachment to the stick of a larger excavator or the boom of a smaller excavator in place of the stick. The mounting bracket includes mounting assemblies that are designed to operatively attach the bracket to the stick and related bucket cylinder linkage assembly of a larger excavator. The mounting bracket also includes mounting assemblies that are designed to operatively attach the bracket to the boom and related stick cylinder of a smaller excavator. The mounting bracket may avoid the need to obtain and maintain plural mounting brackets for different mounting applications (e.g., stick or boom).

32 Claims, 3 Drawing Sheets

U.S. PATENT DOCUMENTS

| | | | | |
|---|---|---|---|---|
| 6,298,560 | B1 * | 10/2001 | Lee | 30/134 |
| 6,364,561 | B1 * | 4/2002 | Droegemueller | 403/4 |
| D458,942 | S | 6/2002 | Balemi | D15/28 |
| 6,662,681 | B2 | 12/2003 | Crane et al. | 74/571 M |
| 6,691,438 | B2 | 2/2004 | Fatemi | 37/468 |
| 6,922,926 | B2 * | 8/2005 | Miller et al. | 37/468 |
| 6,938,514 | B1 * | 9/2005 | Crane et al. | 74/571.1 |
| 2005/0229445 | A1 | 10/2005 | Poquette | 37/468 |

* cited by examiner

MULTIPLE MOUNTING BRACKET FOR A MOBILE PROCESSOR ATTACHMENT MOUNTED ON A HYDRAULIC EXCAVATOR

BACKGROUND OF THE INVENTION

1. Field of the Invention

This invention relates to mounting brackets for mounting processor attachments to excavators.

2. Description of Related Art

As shown in FIG. 1 of U.S. Pat. No. 5,423,625, conventional excavators typically include (a) a curved boom that pivots relative to the tracked or wheeled base machine and (b) a stick (or working arm) that pivotally connects to the boom. A processor attachment (e.g., a bucket, a grapple, material processing shears, etc.) operatively connects to the end of the stick.

Larger excavators (e.g., 40 ton excavators) can typically accommodate relatively heavy stick-mounted processor attachments (e.g., material processing shears) via a stick-mounted mounting bracket. However, such attachments might be too heavy for stick-mounted attachment to smaller excavators (e.g., 20 ton excavators). Accordingly, in some instances, heavy processor attachments mount to smaller excavators in place of the stick via a boom-mounted mounting bracket.

In addition, in some instances, if an operator desires to interchangeably use a processor attachment in boom-mounted and stick-mounted applications, the operator will obtain two mounting brackets, one for stick-mounting and one for boom-mounting.

BRIEF SUMMARY OF THE INVENTION

One aspect of one or more embodiments of the present invention provides a single mounting bracket that is designed to connect a processor attachment to the stick or boom of an excavator or excavators.

Another aspect of one or more embodiments of the present invention provides a mounting bracket for mounting a processor attachment to the boom or stick of excavators. The bracket includes a stick-mounting assembly constructed to pivotally connect to a stick of a first excavator for relative pivotal movement about a stick mounting axis; a bucket-cylinder-linkage-mounting assembly constructed to pivotally connect to a bucket cylinder linkage assembly of the first excavator for relative pivotal movement about a bucket cylinder linkage mounting axis; a boom-mounting assembly constructed to pivotally connect to a boom of a second excavator for relative pivotal movement about a boom mounting axis; and a stick-cylinder-mounting assembly constructed to pivotally connect to a stick cylinder assembly of the second excavator for relative pivotal movement about a stick cylinder mounting axis. The stick-mounting assembly, the bucket-cylinder-linkage-mounting assembly, the boom-mounting assembly, and the stick-cylinder-mounting assembly are mounted to each other.

Another aspect of one or more embodiments of the present invention provides a processor attachment assembly for interchangeable attachment to excavators in stick-mounted and boom-mounted configurations. The assembly includes a processor attachment; means for removably attaching the processor attachment to an excavator in a stick-mounted configuration; and means for removably attaching the processor attachment to an excavator in a boom-mounted configuration. The means for removably attaching the processor attachment to an excavator in a stick-mounted configuration and the means for removably attaching the processor attachment to an excavator in a boom-mounted configuration are operatively connected to the processor attachment.

Another aspect of one or more embodiments of the present invention provides a method of using a mounting bracket for a processor attachment. The method includes attaching a processor attachment to a mounting bracket; attaching the mounting bracket to a first excavator in one of a stick-mounted configuration or a boom-mounted configuration; detaching the mounting bracket from the first excavator after attaching the mounting bracket to the first excavator; and attaching the mounting bracket to a second excavator in the other of the stick-mounted configuration or the boom-mounted configuration.

Another aspect of one or more embodiments of the present invention provides a processor attachment assembly for interchangeable attachment to excavators in stick-mounted and boom-mounted configurations. The assembly includes a processor attachment; and a bracket for mounting the processor attachment to excavators. The bracket has a body that includes a stick mount arranged to connect to a stick of a first excavator, a bucket-cylinder-linkage mount arranged to connect to a bucket cylinder linkage of the first excavator, a boom mount arranged to connect to a boom of a second excavator, and a stick-cylinder mount arranged to connect to a stick cylinder of the second excavator. The stick mount, bucket-cylinder-linkage mount, boom mount, and stick-cylinder mount may be integrally formed, formed as a unitary body, and/or joined to one another.

Additional and/or alternative aspects of the invention will become apparent from the following detailed description, which, taken in conjunction with the annexed drawings, disclose preferred embodiments of the invention.

BRIEF DESCRIPTION OF THE DRAWINGS

Referring now to the drawings which form a part of this original disclosure.

DETAILED DESCRIPTION OF EMBODIMENTS OF THE INVENTION

Figure 1:
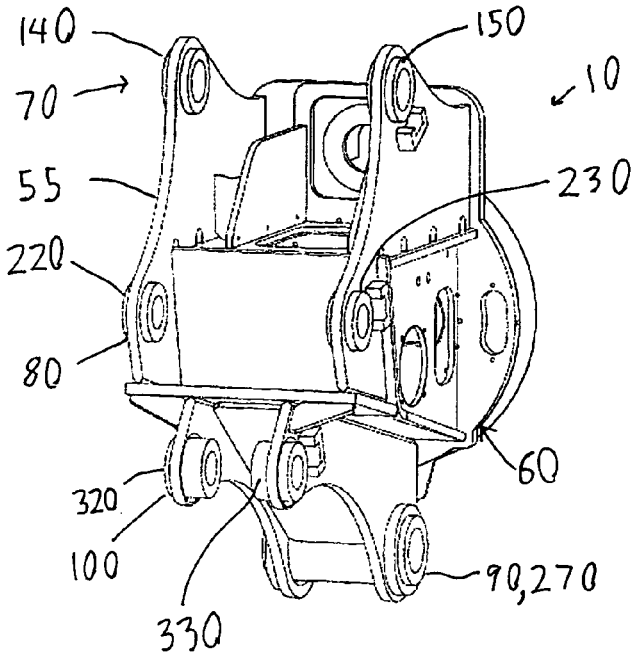
FIG. 1 is a right rear perspective view of a multiple mounting bracket according to an embodiment of the present invention.
Figure 2:
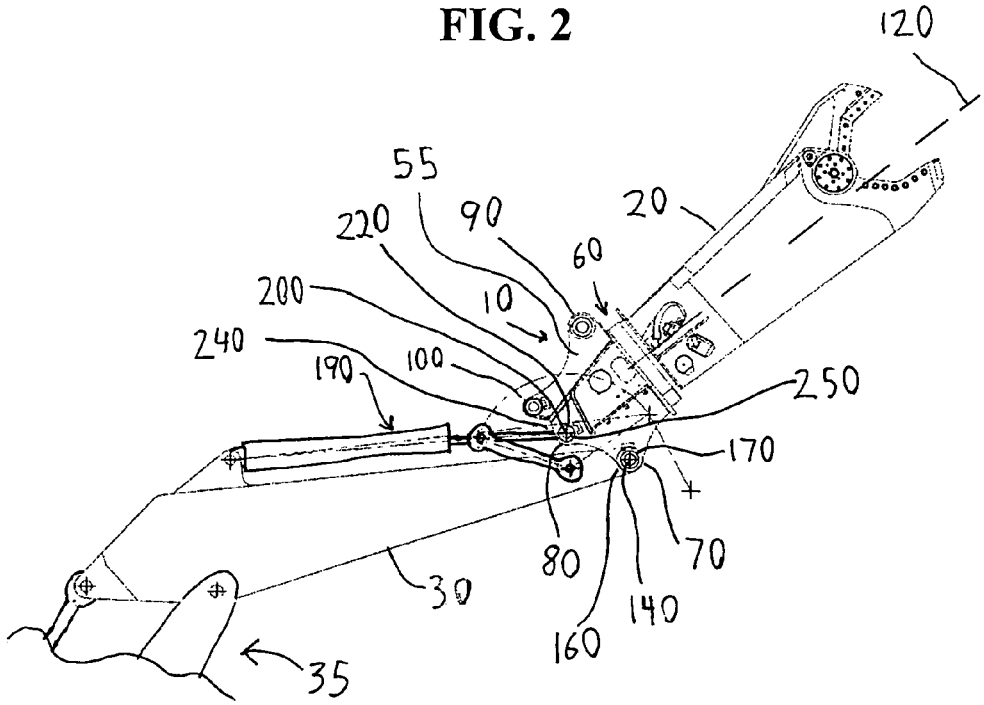
FIG. 2 is a right plan view of the bracket in FIG. 1 mounted to an excavator and processor attachment in a stick-mounted configuration.
Figure 3:
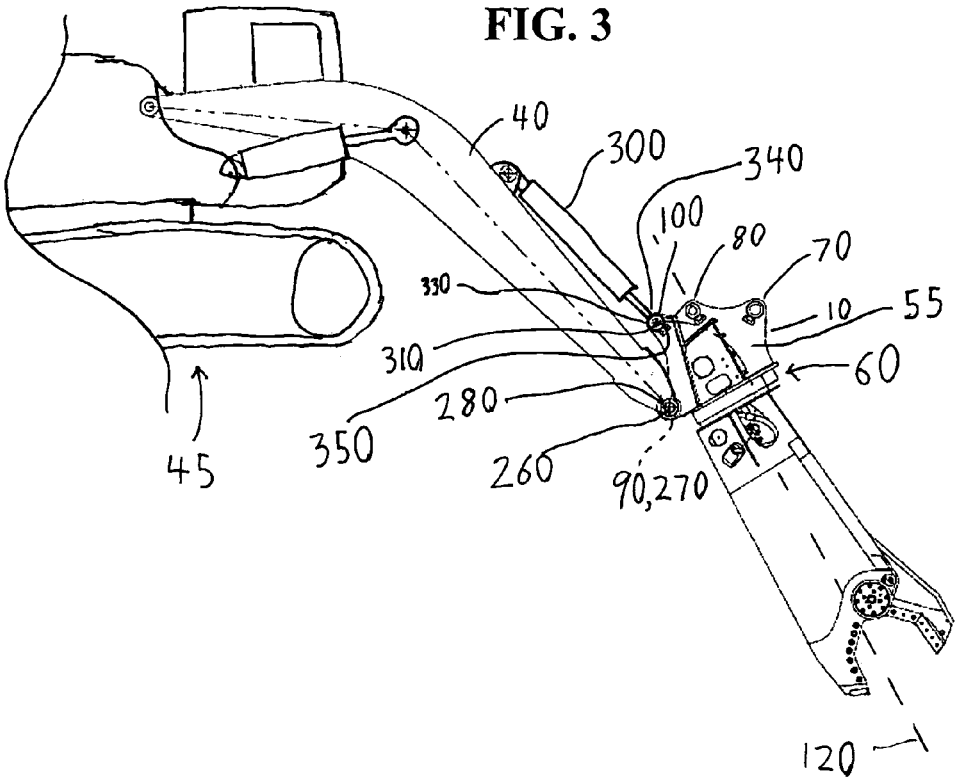
FIG. 3 is a right plan view of the bracket in FIG. 1 mounted to an excavator and processor attachment in a boom-mounted configuration.

FIGS. 1-8 illustrate a multiple mounting bracket 10 according to an embodiment of the present invention. The multiple mounting bracket 10 operatively connects to a processor attachment 20 and interchangeably mounts to a stick 30 of a larger excavator 35 (FIG. 2) or a boom 40 of a smaller excavator 45 in place of its stick (FIG. 3). As discussed in detail below, the bracket 10 comprises a frame 55 that supports a processor attachment mounting assembly 60, a stick-mounting assembly 70, a bucket-cylinder-linkage-mounting assembly 80, a boom-mounting assembly 90, and a stick-cylinder-mounting assembly 100.

As shown in FIGS. 2 and 3, the processor attachment mounting assembly 60 is constructed and arranged to mount the processor attachment 20 to the bracket 10. The illustrated processor attachment assembly 60 comprises a rotary assembly 60 constructed and arranged to pivot the processor attachment 20 relative to the bracket 10 about a longitudinal axis 120 of the bracket 10. Alternatively, the processor attachment mounting assembly 60 may comprise any other suitable means for attaching the bracket 10 to the attachment 20 (e.g., quick coupler; mounting bushings and/or pins for attachment to corresponding bushings/pins of a processor attachment; rigid attachment of the bracket 10 or bracket frame 55 to the attachment 20; integral formation of the bracket 10 or bracket frame 55 with the attachment 20 (e.g., via welding, integration of common components of the bracket 10 or bracket frame 55 and attachment 20, etc.); integration of the mounting assemblies 60, 70, 80, 90 into a frame or housing of the attachment 20; etc.).

If the processor attachment mounting assembly 60 comprises a quick coupler, the longitudinal axis 120 extends in a direction perpendicular to a plane that contains the axes of the processor attachment pins that the coupler engages. If the processor attachment mounting assembly comprises spaced bushings/pins, the axis 120 extends in a direction perpendicular to a plane that includes the axes of the spaced bushings/pins. If the bracket 10 is integrally formed with the processor attachment 20, the longitudinal axis 120 is defined by the longest direction of the combined bracket 10 and processor attachment 20. If the axis 120 is not otherwise defined above, it may be arbitrarily defined in any direction that is perpendicular to the axis 130.

The illustrated processor attachment 20 comprises a material processing shears. However, the processor attachment 20 may alternatively comprise any other suitable type of processor attachment without deviating from the scope of the present invention (e.g., bucket, grapple, drill, compactor, hammer, concrete crusher, etc.).

Figure 6:
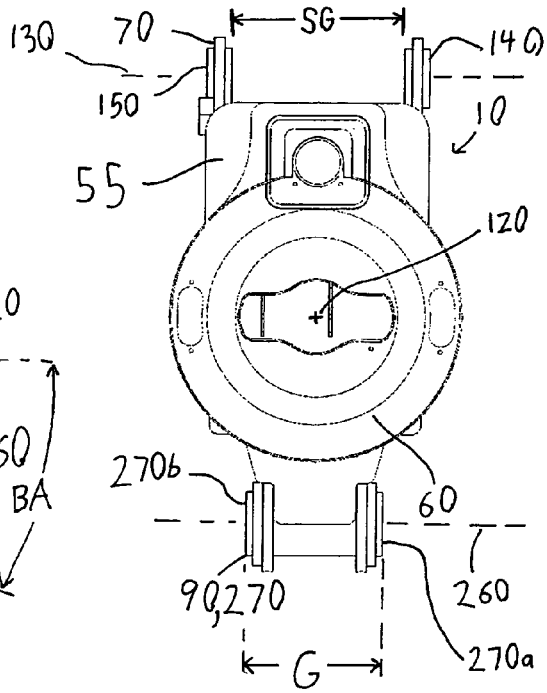
FIG. 6 is a front plan view of the bracket in FIG. 1.
Figure 7:
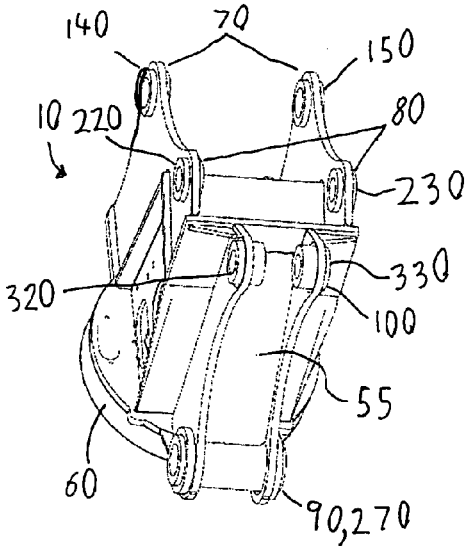
FIG. 7 is a lower left rear perspective view of the bracket in FIG. 1.
Figure 8:
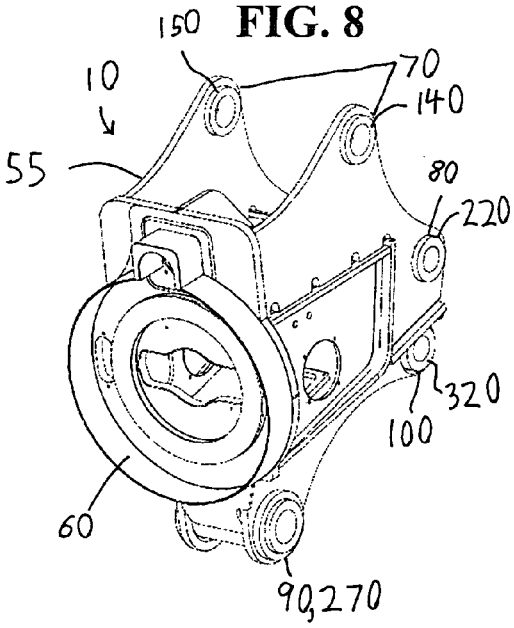
FIG. 8 is an upper left forward perspective view of the bracket in FIG. 1.

As shown in FIG. 2, the stick-mounting assembly 70 pivotally connects to a tip of the stick 30 of a larger excavator 35 for relative pivotal movement about a stick-tip-mounting axis. As shown in FIG. 6, the illustrated stick-mounting assembly 70 comprises left and right stick-mounting bushings 140, 150 that are coaxial with the stick-tip-mounting axis and spaced from each other along the stick tip mounting axis 130 by a stick gap SG. As shown in FIG. 2, the stick gap SG is sized to accommodate a mounting assembly 160 of the tip of the stick 30 being disposed between the bushings 140, 150. A pin 170 extends through the bushings 140, 150 and mounting assembly 160 to create the pivotal connection. According to various embodiments of the present invention, the stick gap SG is at least 4 inches, at least 6 inches, and/or between 6 and 40 inches.

As shown in FIG. 2, the bucket-cylinder-linkage-mounting assembly 80 connects to a bucket cylinder linkage assembly 190 of the larger excavator for relative pivotal movement about a bucket-cylinder-linkage-mounting axis 200. The illustrated bucket cylinder linkage assembly 190 includes a two-way hydraulic cylinder and two linkages, as is conventional. However, the bucket cylinder linkage assembly 190 may alternatively comprise a hydraulic cylinder that connects directly between the stick 30 and the bucket-cylinder-linkage-mounting assembly 80.

Figure 4:
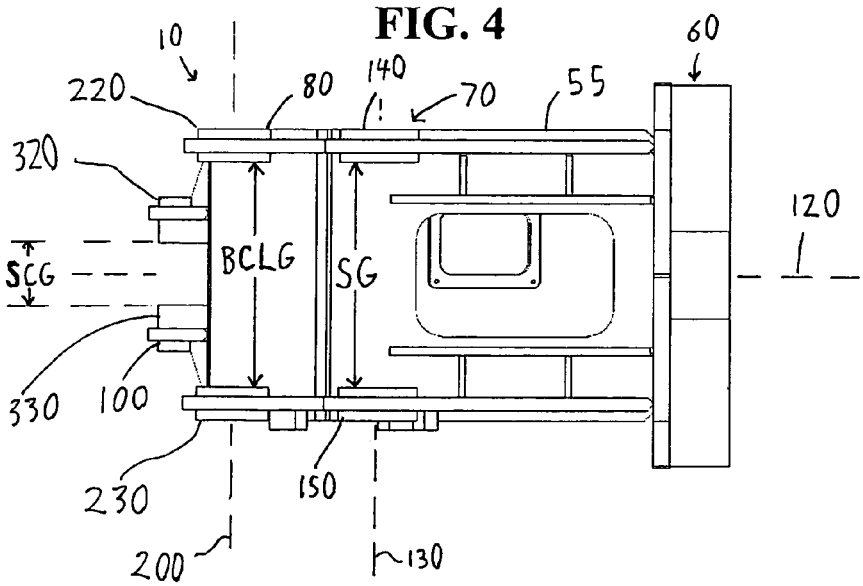
FIG. 4 is a top plan view of the bracket in FIG. 1.

As shown in FIGS. 2 and 4, the bucket-cylinder-linkage-mounting assembly 80 comprises left and right bucket-cylinder-linkage-mounting bushings 220, 230 that are coaxial with the bucket-cylinder-linkage-mounting axis 200 and spaced from each other along the bucket-cylinder-linkage-mounting axis 200 by a bucket cylinder linkage gap BCLG to accommodate a mounting assembly 240 of the bucket cylinder linkage assembly 190. In the illustrated embodiment, the mounting assembly 240 comprises a bushing (not shown). As shown in FIG. 2, a pin 250 extends through the bushings 220, 230 and the bushing of the mounting assembly 240 to created the pivotal connection.

Figure 5:
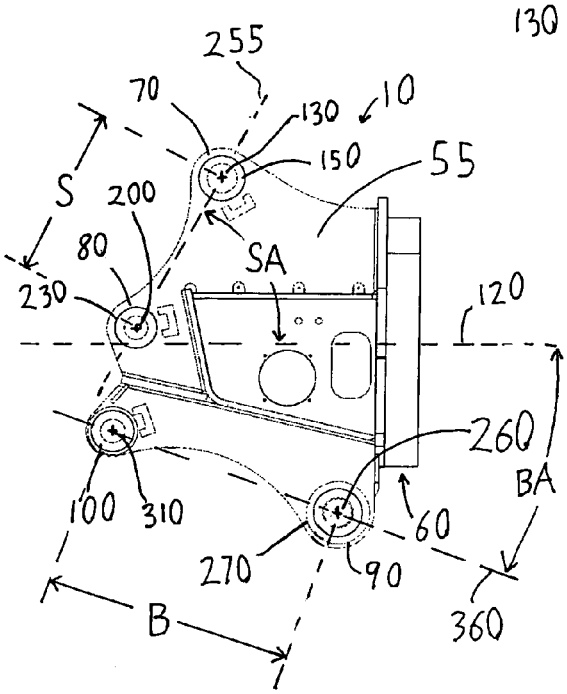
FIG. 5 is a right plan view of the bracket in FIG. 1.

As shown in FIG. 5, the axes 130, 200 are parallel to each other and separated from each other by a distance S (i.e., a pin center distance). A stick-mounting plane 255 that includes both axes 130, 200 forms a stick angle SA with the longitudinal axis 120. The distance S and stick angle SA are preferably dimensioned to appropriately correspond to the stroke of the bucket cylinder linkage assembly 190, thereby providing a useful pivotal range for the bracket 10 and associated processor attachment 20. The distance S and stick angle SA may also be designed such that the bucket cylinder linkage assembly 190 has the best mechanical advantage at the stroke position where power is most needed (e.g., when a longitudinally elongated processor attachment 20 such as a shears extends horizontally). According to various embodiments of the present invention, the distance S is between 6 and 60 inches, between 8 and 36 inches, between 12 and 30 inches, and/or about 17 inches. According to various embodiments of the present invention, the stick angle SA is between 0 and 170 degrees, between 10 and 120 degrees, between 20 and 90 degrees, greater than 30 degrees, greater than 45 degrees, or about 60 degrees.

As shown in FIG. 3, the boom-mounting assembly 90 connects to the boom 40 of the smaller excavator 45 for relative pivotal movement about a boom-mounting axis 260. As shown in FIG. 6, the illustrated boom-mounting assembly 90 comprises a boom-mounting bushing 270 that is coaxial with the boom-mounting axis 260. Opposing axial end surfaces 270*a*, 207*b* of the boom-mounting bushing 270 are spaced from each other by a distance G (see FIG. 6) that is sufficiently small to enable the bushing 270 to fit between laterally-spaced mounting bushings 280 of the excavator boom 40 (see FIG. 3). As shown in FIG. 3, a pin 290 extends through the bushings 280 and bushing 270 to create the pivotal connection.

As shown in FIG. 3, the stick-cylinder-mounting assembly 100 connects to a stick cylinder assembly 300 of the second excavator 45 for relative pivotal movement about a stick cylinder axis 310. The stick-cylinder-mounting assembly 100 comprises left and right stick-cylinder-mounting bushings 320, 330 that are coaxial with the stick-cylinder-mounting axis 310 and spaced from each other along the stick-cylinder-mounting axis 310 by a stick cylinder gap SCG (see FIG. 4) that is sized to accommodate a mounting assembly 340 (e.g., a bushing) of the stick cylinder assembly 300. As shown in FIG. 3, a pin 350 extends through the bushings 320, 330, 340 to create the pivotal connection.

In the illustrated embodiment, the stick cylinder assembly 300 comprises a stick cylinder 300 that directly extends between the boom 40 and the stick-cylinder-mounting assembly 100. The mounting assembly 340 comprises a bushing at the end of the stick cylinder 300. Alternatively, the stick cylinder assembly 300 may comprise a stick cylinder and an intermediate linkage (as is common for bucket cylinder linkage assemblies as shown in FIG. 2) without deviating from the scope of the present invention. In such an embodiment, the mounting assembly 340 may comprise a bushing disposed on an intermediate linkage that extends between the stick cylinder and the stick-cylinder-mounting assembly 100.

As shown in FIG. 5, the axes 90, 100 are parallel to each other and separated from each other by a distance B (i.e., a pin center distance). A boom-mounting plane 360 that includes both axes 90, 100 forms a boom angle BA with the longitudinal axis 120. The distance B and boom angle BA are preferably dimensioned to appropriately correspond to the stroke of the stick cylinder assembly 300, thereby providing a useful pivotal range for the bracket 10 and associated processor attachment 20. The distance B and boom angle BA may also be designed such that the stick cylinder assembly 300 has the best mechanical advantage at the stroke position where power is most needed. According to various embodiments of the present invention, the distance B is between 20 and 56 inches. According to various embodiments of the present invention, the boom angle BA is between 0 and 170 degrees (positive or negative), between 0 and 120 degrees, between 0 and 90 degrees, between 0 and 60 degrees, between 0 and 45 degrees, between 0 and 30 degrees, or about 20 degrees.

The distances S, SG, and BCLG and angle SA are preferably designed to accommodate mounting the bracket 10 to the stick 30 and bucket cylinder linkage assembly 190 via the stick-mounting assembly 70 and bucket-cylinder-linkage-mounting assembly 80 as shown in FIG. 2. Similarly, the distances B, G, and SCG and angle BA are preferably designed to accommodate mounting the bracket 10 to the boom 40 and stick cylinder assembly 300 via the boom-mounting assembly 90 and stick-cylinder-mounting assembly 100. According to one embodiment of the present invention, as shown in FIG. 6 the distance G is smaller than the distance SG. According to one embodiment of the present invention, as shown in FIG. 4, the distances BCLG and SG are equal to each other. According to one embodiment of the present invention, as shown in FIG. 4, the distances BCLG and SG are each larger than the distance SCG. According to one embodiment of the present invention, as shown in FIG. 5, the distance B is larger than the distance S. According to one embodiment of the present invention, as shown in FIG. 5, the angle SA is larger than the angle BA. According to one embodiment of the present invention, as shown in FIG. 5, the planes 255 and 360 are non parallel (i.e., a non-zero angle is formed between the planes 255, 360). According to one embodiment of the present invention, as shown in FIG. 5, the angles BA and SA differ from each other. According to various embodiments of the present invention, the distance BCLG is at least 4 inches, at least 6 inches, and/or between 6 and 40 inches. According to various embodiments of the present invention, the distance SCG is at least 2 inches, at least 4 inches, and/or between 4 and 40 inches. According to various embodiments of the present invention, the distance G is at least 10 inches and/or at least 20 inches.

These dimensions and angles may be dependent on the particular excavators the bracket is to be fitted to. To accommodate third, fourth, or more mounting possibilities (e.g., for additional excavators or additional mounting locations), additional pins, sleeves, and spacer kits may be provided to adapt the existing mounting assembly or assemblies to the additional mounting possibility. For example, a sleeve may fit over a pin to increase a pin diameter. A sleeve may be placed within the bushings 140, 150 to reduce the inside diameter of the bushings 140, 150 to accommodate a smaller diameter pin. As shown in FIG. 6, washers, spacers, and/or spools may be placed between the bushings 140, 150 to reduce the distance SG. Washers or other spacers may be placed laterally outwardly from the bushing 270 to increase the distance G. Moreover, while the illustrated bracket 10 includes mounting assemblies for just two positions (e.g., one boom-mounting and one stick-mounting), the bracket 10 may also include additional mounting assemblies for additional possibilities without deviating from the scope of the present invention (e.g., an additional set of mounting assemblies for mounting the bracket to a second boom or stick that dimensionally differs from the first boom or stick).

In the illustrated embodiment, the distances SG, BCLG, and SCG are uninterrupted spaces. However, according to alternative embodiments, additional mounting points (e.g., bushings, etc.) may be disposed along one or more of the distances SG, BCLG, and SCG to accommodate the mounting of multiple forked portions of mating components in a meshing manner or to accommodate dual spaced cylinders The bracket 10 enables an operator to use a single bracket 10 to interchangeably attach the processor attachment 20 to an excavator(s) in a stick-mounted or boom-mounted configuration. The multi-purpose bracket 10 helps an operator to quickly and easily detach the stick-mounted bracket 10 and attachment 20 from one excavator and attach the bracket 10 and attachment 20 to the same or a different excavator in a boom-mounted configuration.

According to an alternative embodiment of the present invention, an operator connects the stick-mounting assembly 70 and bucket-cylinder-linkage-mounting assembly 80 to a quick change coupler of an excavator instead of attaching the assemblies 70, 80 directly to a stick 30 and bucket cylinder linkage assembly 190. The assemblies 70, 80 are appropriately sized and shaped such that pins attached to the assemblies 70, 80 are compatible with the quick change coupler.

In the illustrated embodiment, as shown in FIG. 5, all four axes 130, 200, 260, and 310 are spaced from each other by fixed non-zero distances. Alternatively, two of the axes may be coaxial. For example, the stick- and boom-cylinder axes 310, 200 may be coaxially aligned without deviating from the scope of the present invention. Alternatively, the mounting assemblies 70, 80, 90, 100 may provide for variably spaced axes 130, 200, 260, 310 (e.g., as shown in U.S. Pat. Nos. 5,927,665, 6,662,681, and/or 6,938,514, which are hereby incorporated by reference).

In the illustrated embodiment, the bushings 140, 150, 220, 230, 320, 330, 270 are defined by bores in the bracket frame 55 and one or more associated coaxial annular members that are welded or otherwise attached to the bracket frame 55. Alternatively, one or more of the bushings 140, 150, 220, 230, 320, 330, 270 may be defined by any other suitable structure (e.g., plate material that forms part of the bracket frame 55 and includes a hole centered on the axis of the bushing; ball bearings, etc.) without deviating from the scope of the present invention.

The illustrated stick-mounting assembly 70, bucket-cylinder-linkage-mounting assembly 80, boom-mounting assembly 90, and stick-cylinder-mounting assembly 100 each comprise one or more bushings 140, 150, 220, 230, 320, 330, 270. Alternatively, the stick-mounting assembly 70, bucket-cylinder-linkage-mounting assembly 80, boom-mounting assembly 90, and/or stick-cylinder-mounting assembly 100 may comprise any other suitable mounting assembly without deviating from the scope of the present invention (e.g., pins aligned with the axis of the mounting assembly, quick couplers, etc.).

The bracket frame 55 may comprise a plurality of components (e.g., plates; gussets; sheet material etc.) that are welded or otherwise connected to each other (e.g., via bolts, interference fits, screws, etc.). Two or more of these frame 55 components may be commonly cast together or created via die stamping or bending. The mounting assemblies 60, 70, 80,

90, 100 are mounted to or integrally formed with the bracket frame 55 such that the mounting assemblies 60, 70, 80, 90, 100 are all mounted to each other and form part of the single bracket 10.

The foregoing description is included to illustrate the operation of the preferred embodiments and is not meant to limit the scope of the invention. To the contrary, those skilled in the art should appreciate that varieties may be constructed and employed without departing from the scope of the invention, aspects of which are recited by the claims appended hereto.

What is claimed is:

1. A mounting bracket for mounting a processor attachment to the boom or stick of excavators, the bracket comprising:

a stick-mounting assembly constructed to pivotally connect to a stick of a first excavator for relative pivotal movement about a stick mounting axis;

a bucket-cylinder-linkage-mounting assembly constructed to pivotally connect to a bucket cylinder linkage assembly of the first excavator for relative pivotal movement about a bucket cylinder linkage mounting axis;

a boom-mounting assembly constructed to pivotally connect to a boom of a second excavator for relative pivotal movement about a boom mounting axis; and a stick-cylinder-mounting assembly constructed to pivotally connect to a stick cylinder assembly of the second excavator for relative pivotal movement about a stick cylinder mounting axis, wherein the stick-mounting assembly, the bucket-cylinder-linkage-mounting assembly, the boom-mounting assembly, and the stick-cylinder-mounting assembly are mounted to each other, wherein the bracket has a longitudinal axis that is perpendicular to the stick mounting axis, wherein the bracket is constructed and arranged to connect to the stick in a first orientation about the longitudinal axis relative to the stick, and wherein the bracket is constructed and arranged to connect to the boom in a second orientation about the longitudinal axis relative to the boom, the second orientation differing from the first orientation by 180 degrees about the longitudinal axis.

2. The bracket of claim 1, wherein:

the stick mounting axis and bucket cylinder linkage mounting axis are parallel to each other, and wherein the boom mounting axis and stick cylinder mounting axis are parallel to each other;

the stick mounting axis and bucket cylinder linkage mounting axis are separated from each other by a first distance; and the boom mounting axis and stick cylinder mounting axis are separated from each other by a second distance.

3. The bracket of claim 2, wherein the second distance is larger than the first distance.

4. The bracket of claim 2, wherein:

the first distance is between 12 and 30 inches; and the second distance is between 20 and 56 inches.

5. The bracket of claim 1, wherein:

a boom-mounting plane includes the boom mounting axis and stick cylinder mounting axis;

a stick-mounting plane includes the stick mounting axis and the bucket cylinder linkage mounting axis; and a non-zero angle is formed between the boom-mounting plane and stick-mounting plane.

6. The bracket of claim 5, wherein:

a boom angle is defined between a longitudinal axis of the bracket and the boom plane;

a stick angle is defined between the longitudinal axis and the stick plane;

the boom angle differs from the stick angle.

7. The bracket of claim 6, wherein the bracket comprises a rotary assembly constructed and arranged to enable the processor attachment to pivot relative to the bracket about the longitudinal axis.

8. The bracket of claim 6, wherein:

the boom angle is less than 30 degrees; and the stick angle is larger than 30 degrees.

9. The bracket of claim 8, wherein the stick angle is larger than 45 degrees.

10. The bracket of claim 1, further comprising means for attaching the bracket to the processor attachment.

11. The bracket of claim 10 in combination with a processor attachment attached to the bracket by the means for attaching.

12. The bracket of claim 1, wherein:

the stick-mounting assembly comprises a laterally-extending aperture in the bracket that is coaxial with the stick mounting axis;

the bucket-cylinder-linkage-mounting assembly comprises a laterally-extending aperture in the bracket that is coaxial with the bucket cylinder linkage mounting axis;

the boom-mounting assembly comprises a laterally-extending aperture in the bracket that is coaxial with the boom mounting axis; and the stick-cylinder-mounting assembly comprises a laterally-extending aperture in the bracket that is coaxial with the stick cylinder mounting axis.

13. The bracket of claim 1, wherein:

the stick-mounting assembly comprises first and second stick-mounting bushings that are coaxial with the stick mounting axis and spaced from each other along the stick mounting axis by a stick gap to accommodate a mounting assembly of the stick being disposed therebetween;

the bucket-cylinder-linkage-mounting assembly comprises first and second bucket-cylinder-linkage-mounting bushings that are coaxial with the bucket cylinder linkage mounting axis and spaced from each other along the bucket cylinder linkage mounting axis by a bucket cylinder linkage gap to accommodate a mounting assembly of the bucket cylinder linkage being disposed therebetween;

the boom-mounting assembly comprises a boom-mounting bushing that is coaxial with the boom mounting axis, the boom-mounting bushing being constructed and shaped to fit between spaced bushings of the excavator boom; and the stick-cylinder-mounting assembly comprises first and second stick-cylinder-mounting bushings that are coaxial with the stick cylinder mounting axis and spaced from each other along the stick cylinder mounting axis by a stick cylinder gap to accommodate a mounting assembly of the stick cylinder being disposed therebetween.

14. The bracket of claim 13, wherein:

the stick gap is at least 4 inches;

the bucket cylinder linkage gap is at least 6 inches;

the stick cylinder gap is at least 2 inches; and opposing axial end surfaces of the boom-mounting bushing are spaced from each other by at least 10 inches.

15. The bracket of claim 13, wherein the stick gap is wider than the boom-mounting bushing.

16. The bracket of claim 1; wherein the bracket is constructed and arranged such that the stick-mounting assembly, the bucket-cylinder-linkage-mounting assembly, the boom-mounting assembly, and the stick-cylinder-mounting assembly remain mounted to each other regardless of how the bracket is mounted to an excavator.

17. The bracket of claim 1, wherein the stick mounting axis is, spaced from the boom mounting axis.

18. The bracket of claim 1, wherein the stick mounting axis, the bucket cylinder linkage mounting axis, the boom mounting axis, and the stick cylinder mounting axis are all spaced from each other.

19. A method of using a mounting bracket for a processor attachment, the method comprising:

attaching a processor attachment to a mounting bracket, the mounting bracket comprising a boom-mounting assembly mounted to a stick-mounting assembly;

attaching the mounting bracket to a first excavator in one of a stick-mounted configuration via the stick-mounting assembly, or a boom-mounted configuration via the boom-mounting assembly;

detaching the mounting bracket from the first excavator after attaching the mounting bracket to the first excavator; and attaching the mounting bracket to a second excavator in the other of the stick-mounted configuration via the stick-mounting assembly, or the boom-mounted configuration via the boom-mounting assembly, wherein attaching the mounting bracket to an excavator in the boom-mounted configuration comprises attaching the mounting bracket to a stick-cylinder assembly of the excavator, wherein the mounting bracket has a longitudinal axis, and wherein said attaching of the mounting bracket to the second excavator comprises attaching the mounting bracket to the second excavator in an orientation that is pivoted 180 degrees about the longitudinal axis relative to an orientation that the bracket was mounted to the first excavator.

20. The method of claim 19, wherein:

attaching the mounting bracket to the first excavator comprises connecting the bracket to a quick change coupler of the first excavator, and attaching the mounting bracket to the second excavator comprises connecting the bracket to a boom of the second excavator for relative pivotal movement about a boom mounting axis, and connecting the bracket to a stick cylinder assembly of the second excavator for relative pivotal movement about a stick cylinder mounting axis.

21. The method of claim 19, wherein:

attaching the mounting bracket to the first excavator comprises connecting the bracket to a stick of the first excavator for relative pivotal movement about a stick mounting axis, and connecting the bracket to a bucket cylinder linkage assembly of the first excavator for relative pivotal movement about a bucket cylinder linkage mounting axis; and attaching the mounting bracket to the second excavator comprises connecting the bracket to a boom of the second excavator for relative pivotal movement about a boom mounting axis, and connecting the bracket to a stick cylinder assembly of the second excavator for relative pivotal movement about a stick cylinder mounting axis.

22. The method of claim 21, wherein:

the bracket comprises a stick-mounting assembly, a bucket-cylinder-linkage-mounting assembly, a boom-mounting assembly, and a stick-cylinder-mounting assembly;

connecting the bracket to the stick comprises connecting the stick-mounting assembly to the stick for relative pivotal movement about the stick mounting axis;

connecting the bracket to the bucket cylinder linkage assembly comprises connecting the bucket-cylinder-linkage-mounting assembly to the bucket cylinder linkage assembly for relative pivotal movement about the bucket cylinder linkage mounting axis;

connecting the bracket to the boom comprises connecting boom-mounting assembly to the boom for relative pivotal movement about the boom mounting axis; and connecting the bracket to the stick cylinder assembly comprises connecting the stick-cylinder-mounting assembly to the stick cylinder for relative pivotal movement about the stick cylinder mounting axis.

23. The method of claim 21, wherein the stick mounting axis is spaced from the boom mounting axis.

24. The method of claim 19, wherein:

upon said attaching of the mounting bracket to the first excavator, the boom-mounting assembly remains mounted to the stick-mounting assembly, and upon said attaching of the mounting bracket to the second excavator, the boom-mounting assembly remains mounted to the stick-mounting assembly.

25. The method of claim 19, wherein attaching the mounting bracket to an excavator in the boom-mounted configuration further comprises attaching the mounting bracket to the boom of an excavator in place of a stick of such excavator.

26. The method of claim 19, wherein attaching the mounting bracket to an excavator in the boom-mounted configuration comprises detaching a stick from the stick-cylinder assembly of the excavator before attaching the mounting bracket to the stick-cylinder assembly of the excavator.

27. An assembly for interchangeable attachment to excavators in stick-mounted and boom-mounted configurations, the assembly comprising:

a bracket for mounting a processor attachment to excavators, said bracket having a body that includes a stick mount arranged to connect to a stick of a first excavator for pivotal movement of the bracket relative to the stick about a stick mounting axis, a bucket-cylinder-linkage mount arranged to connect to a bucket cylinder linkage of the first excavator, a boom mount arranged to connect to a boom of a second excavator, and a stick-cylinder mount arranged to connect to a stick cylinder of the second excavator, wherein the stick mount, bucket-cylinder-linkage mount, boom mount, and stick-cylinder mount are joined to one another, wherein the bracket has a longitudinal axis that is perpendicular to the stick mounting axis, wherein the bracket is constructed and arranged to connect to the stick in a first orientation about the longitudinal axis relative to the stick, and wherein the bracket is constructed and arranged to connect to the boom in a second orientation about the longitudinal axis relative to the boom, the second orientation differing from the first orientation by 180 degrees about the longitudinal axis.

28. The assembly of claim 27, wherein the stick mount, bucket-cylinder-linkage mount, boom mount, and stick-cylinder mount are integrally formed.

29. The assembly of claim 27, wherein the stick mount, bucket-cylinder-linkage mount, boom mount, and stick-cylinder mount are formed as a unitary body:

30. The assembly of claim 27, further comprising a processor attachment connected to the bracket.

31. The assembly of claim 27, wherein the stick mount and boom mount are spaced from each other.

32. A mounting bracket for mounting a processor attachment to a boom of an excavator or a stick of an excavator, the bracket comprising:

means for removably attaching the bracket to a stick of an excavator in a stick-mounted configuration for pivotal movement of the bracket relative to the stick about a stick mounting axis; and means for removably attaching the bracket to a boom of an excavator in a boom-mounted configuration such that the bracket mounts to a stick cylinder of the excavator, wherein said means for removably attaching the bracket to an excavator in a stick-mounted configuration and said means for removably attaching the bracket to an excavator in a boom-mounted configuration are mounted to each other and, constructed and arranged to be connected to a processor attachment, and wherein the bracket has a longitudinal axis that is perpendicular to the stick mounting axis, wherein the means for removably attaching the bracket to a stick is constructed and arranged to connect the bracket to the stick such that the bracket is in a first orientation about the longitudinal axis relative to the stick, and wherein the means for removably attaching the bracket to a boom is constructed and arranged to connect the bracket to the boom in a second orientation about the longitudinal axis relative to the boom, the second orientation differing from the first orientation by 180 degrees about the longitudinal axis.

* * * * *